US005454436A

United States Patent [19]

Jardine et al.

[11] Patent Number: 5,454,436

[45] Date of Patent: Oct. 3, 1995

[54] METHOD OF WARNING OF PIPE STICKING DURING DRILLING OPERATIONS

[75] Inventors: Stuart I. Jardine, Cambridge, England; Dominic P. J. McCann; David B. White, both of Sugar Land, Tex.

[73] Assignee: Schlumberger Technology Corporation, Sugar Land, Tex.

[21] Appl. No.: 265,288

[22] Filed: Jun. 24, 1994

[30] Foreign Application Priority Data

Jun. 25, 1993 [GB] United Kingdom ..... 9313102

[51] Int. Cl.[6] ..... E21B 47/00

[52] U.S. Cl. ..... 175/40; 175/48; 175/61

[58] Field of Search ..... 175/40, 48, 61, 175/65; 166/250

[56] References Cited

U.S. PATENT DOCUMENTS

| | | | |
|---|---|---|---|
| 3,740,739 | 6/1973 | Griffin, III et al. | 175/48 X |
| 4,298,078 | 11/1981 | Lawrence | 175/72 |
| 4,423,791 | 1/1984 | Moses, Jr. | 175/65 |
| 4,427,080 | 1/1984 | Steiger | 175/325 |
| 4,428,441 | 1/1984 | Dellinger | 175/61 |
| 4,685,329 | 8/1987 | Burgess | 175/39 X |
| 4,715,451 | 12/1987 | Bseisu et al. | 175/40 |
| 4,791,998 | 12/1988 | Hempkins et al. | 175/61 |
| 4,958,125 | 9/1990 | Jardine et al. | 175/40 X |

*Primary Examiner*—Ramon S. Britts

*Assistant Examiner*—Frank S. Tsay

*Attorney, Agent, or Firm*—Wayne I. Kanak

[57] ABSTRACT

A method of warning of the onset of pipe sticking in a rotary drilling operation using a drill string comprising: (a) monitoring the pressure of a drilling fluid being pumped through the drill string during drilling over predetermined periods of time to obtain series of pressure measurements; (b) monitoring the torque required to rotate the drill string during said periods to obtain series of torque measurements; (c) obtaining the skew (third moment) of each series of pressure measurements according to the relationship $$\text{skew} = \frac{1}{N}\ \Sigma[(xi - \text{xmean})/\sigma]^3,$$

wherein N is the number of pressure measurements xi in the series, xmean is the average value of the measurements in the series, and σ is the standard deviation of the measurements in the series; (d) obtaining the normalized standard deviation σn of the torque measurements in each corresponding series of torque measurements according to the relationship σn=(σ/ymean) wherein σ is the standard deviation of the measurements in the series and ymean is the average value of the measurements in the series; and (e) comparing skew and σn for the series so as to identify corresponding changes in both and raising an alarm when the magnitude of said changes pass predetermined alarm values.

12 Claims, 6 Drawing Sheets

METHOD OF WARNING OF PIPE STICKING DURING DRILLING OPERATIONS

BACKGROUND OF THE INVENTION

1. Field of the Invention

The present invention relates to a method of warning of the onset of pipe sticking during rotary drilling operations.

2. Description of the Related Art

In rotary drilling operations a drill string made of a series of pipes joined end to end with a drill bit attached to the bottom is rotated in the borehole and drilled material is carried from the bottom of the borehole by means of drilling fluid which is pumped down inside the drill string and returns to the surface in the annular space outside the drill string carrying the drilled material with it. From time to time the drill string can become stuck due to interaction with the borehole. The drill string becomes stuck when the torque or overpull which can be applied to the drill string at the surface is insufficient to free the drill string from its interaction with the borehole.

Stuck pipe is undesirable since it often results in long periods of lost drilling time and occasionally lost equipment in the borehole when it is not possible to free the drill string which must then be cut and the borehole sidetracked to avoid the stuck part of the drill string remaining in the hole. Methods have been proposed for identifying situations when sticking is starting to occur. These can involve monitoring parameters such as hookload at the surface when pulling the drill string out of the hole. However, none of these is known to provide advance warning of the onset of pipe sticking.

SUMMARY OF THE INVENTION

It is an object of the present invention to provide a method which allows the onset of sticking during a drilling operation and raise an alarm so that appropriate action can be taken to avoid becoming stuck.

The present invention provides a method of warning of the onset of pipe sticking in a rotary drilling operation using a drill string comprising:

(a) monitoring the pressure of a drilling fluid being pumped through the drill string during drilling over predetermined periods of time to obtain series of pressure measurements;

(b) monitoring the torque required to rotate the drill string during said periods to obtain series of torque measurements;

(c) obtaining the skew (third moment) of each series of pressure measurements according to the relationship $$\text{skew} = \frac{1}{N} \Sigma [(xi - x\text{mean})/\sigma]^3$$

wherein N is the number of pressure measurements xi in the series, xmean is the average value of the measurements in the series, and σ is the standard deviation of the measurements in the series;

(d) obtaining the normalized standard deviation σn of the torque measurements in each corresponding series of torque measurements according to the relationship $$\sigma_n = (\sigma/\text{ymean})$$

wherein σ is the standard deviation of the measurements in the series and ymean is the average value of the measurements in the series; and (e) comparing skew and $\sigma_n$ for the series so as to identify corresponding changes in both and raising an alarm when the magnitude of said changes pass predetermined alarm values.

The step of comparing the skew and $\sigma_n$ for the series preferably comprises obtaining the product of the skew and $\sigma_n$ and monitoring the development of said product and raising the alarm when the value of the product exceeds an alarm value.

It is also preferred that the product of skew and $\sigma_n$ is integrated over a period of time and the integrated value is updated on a regular basis. The current value of the integral is used to trigger the alarm. The integration period is typically around 1–2 hours and the integrated value is updated every minute or so.

Typically the predetermined period of time is of the order of 120 seconds and calculations are repeated say every 60 seconds.

The advantage of the present invention is that it provides a method of using different measured parameters, each of which include information concerning the onset of sticking amongst other features, to produce a single diagnostic which is wholly indicative of the onset of sticking.

BRIEF DESCRIPTION OF THE DRAWINGS

The invention will now be described by way of example, with reference to the drawings, in which.

DESCRIPTION OF THE PREFERRED EMBODIMENT

Figure 1:
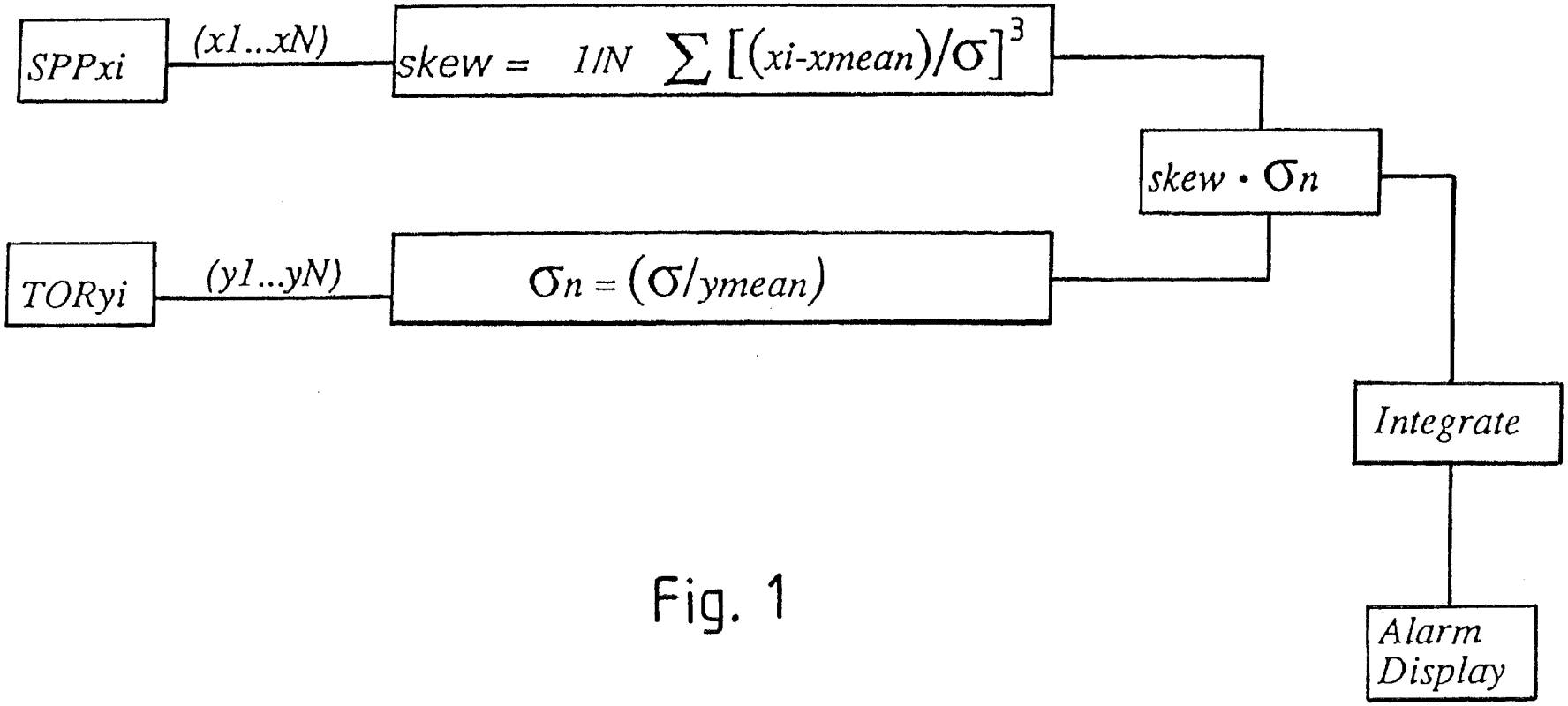
FIG. 1 shows a flow diagram of a method according to the present invention.

Referring now to the drawings, the major steps of the method are shown in FIG. 1. During drilling, the pressure of drilling fluid being pumped through the drill string is measured. This is most conveniently done by measuring the pressure of the drilling fluid in the standpipe before it enters the drill string proper. Measurement of the standpipe pressure SPPxi is continuous and regular and series of measurements ($x_1 \ldots x_N$) falling within a time window, typically of 120 seconds, are obtained. The skew or third moment of each series is obtained according to the relationship $$\text{skew} = \frac{1}{N} \Sigma [(xi - x\text{mean})/\sigma]^3$$

wherein N is the number of pressure measurements xi in the series, xmean is the average value of the measurements in the series, and σ is the standard deviation of the measurements in the series. Simultaneously with the measurement of the standpipe pressure, the torque TORyi required to rotate the drill string during drilling is measured continuously over the same time window as the standpipe pressure and corresponding series of torque measurements ($y_1 \ldots y_N$) are obtained. The normalized standard deviation σn of each series is obtained according to the relationship σn=(σ/ymean) wherein σ is the standard deviation of the measurements in the series and ymean is the average value of the measurements in the series. The skew of one series of standpipe pressure measurements and the normalized standard deviation of the corresponding series of torque measurements are then multiplied together to obtain a dimensionless diagnostic value which is compared with a predetermined alarm value and displayed on a visual display. When the diagnostic value exceeds the alarm value, a sound and/or visual alarm can be raised to indicate the onset of pipe sticking to the driller who can the take appropriate action to avoid becoming stuck. The measurement of torque and standpipe pressure is routine and needs no specific description and all of the computational steps described above can be completed by a suitably programmed computer at the rig site. In the preferred method as shown in FIG. 1, the diagnostic values are integrated over a period of time, typically 1–2 hours and it is the integral which is used to raise the alarm and appear on a display. The integral is typically updated every minute or so.

Figure 2A:
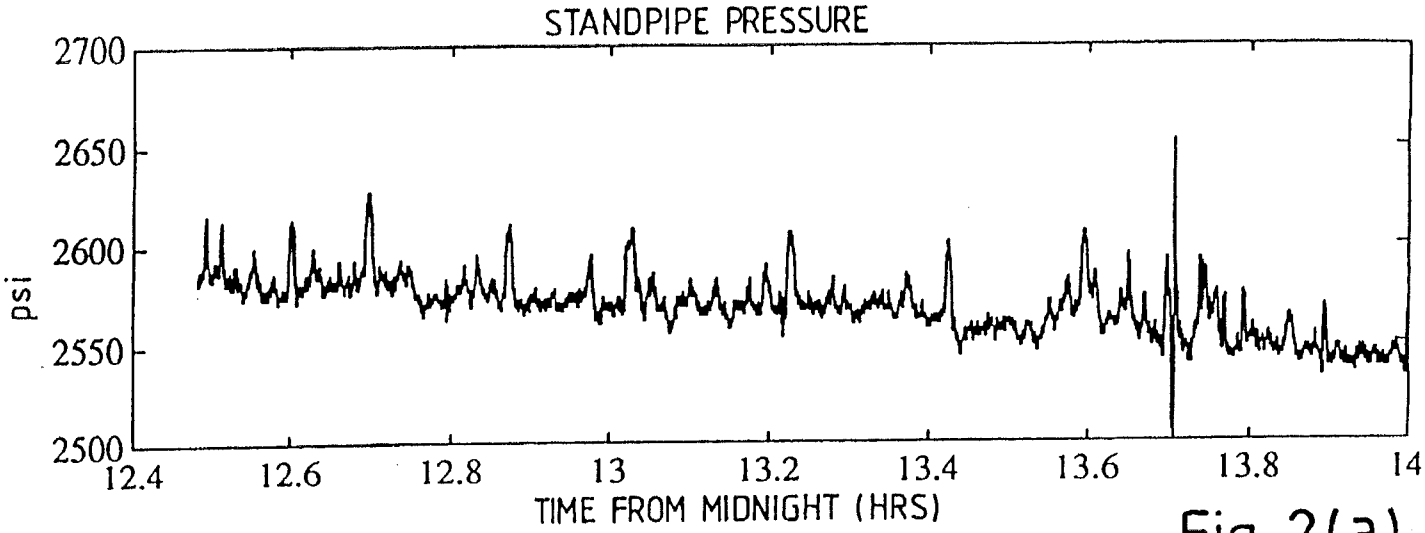
FIGS. 2*a* and 2*b* show plots of standpipe pressure and torque during drilling prior to a stuck pipe event.
Figure 2B:
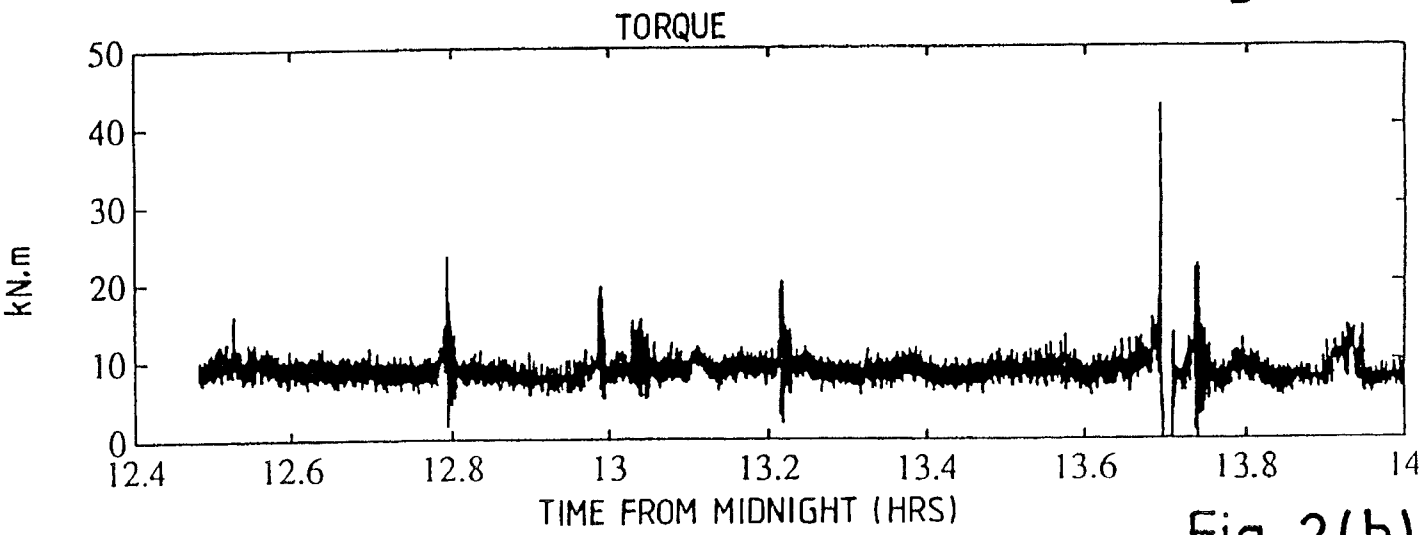

The application of the method described above will now be described with reference to the standpipe pressure and torque data shown in FIGS. 2*a* and 2*b*. In the drilling operation from which this data was obtained, drilling was stopped at 14:20 hours to change the bit but after pulling only one stand from the hole, the drill string became stuck. FIGS. 2*a* and 2*b* show data from 12:50 hours up to the time drilling was stopped and both plots have similar scaling. The standpipe pressure shows pulses of around 40 psi in 2600 psi and large variations in torque can also be seen, some of which correspond with the pressure pulses. For example, at 13:75 hours a severe torque fluctuation correlates with an increase in standpipe pressure. The data from this period is plotted on an expanded scale in FIGS. 3*a* and 3*b*. At this time, the formation momentarily grabs the drill string causing a large amplitude torque fluctuation and restricting the flow causing the standpipe pressure increase 2–3 seconds later. The time difference between the torque and pressure events is due to the differences in velocity between torsional waves in the drill string and the velocity of a pressure wave in the mud. The torque data shows that the lowest frequency torsional mode of oscillation of the drill string has been excited. This is likely to be caused by severe interaction with the formation via stabilizers, cave-ins or cuttings build-up. The pulses on the standpipe pressure combined with the high torque oscillations are believed to be good indicator of blocking of the annulus by the formation.

Figure 3:
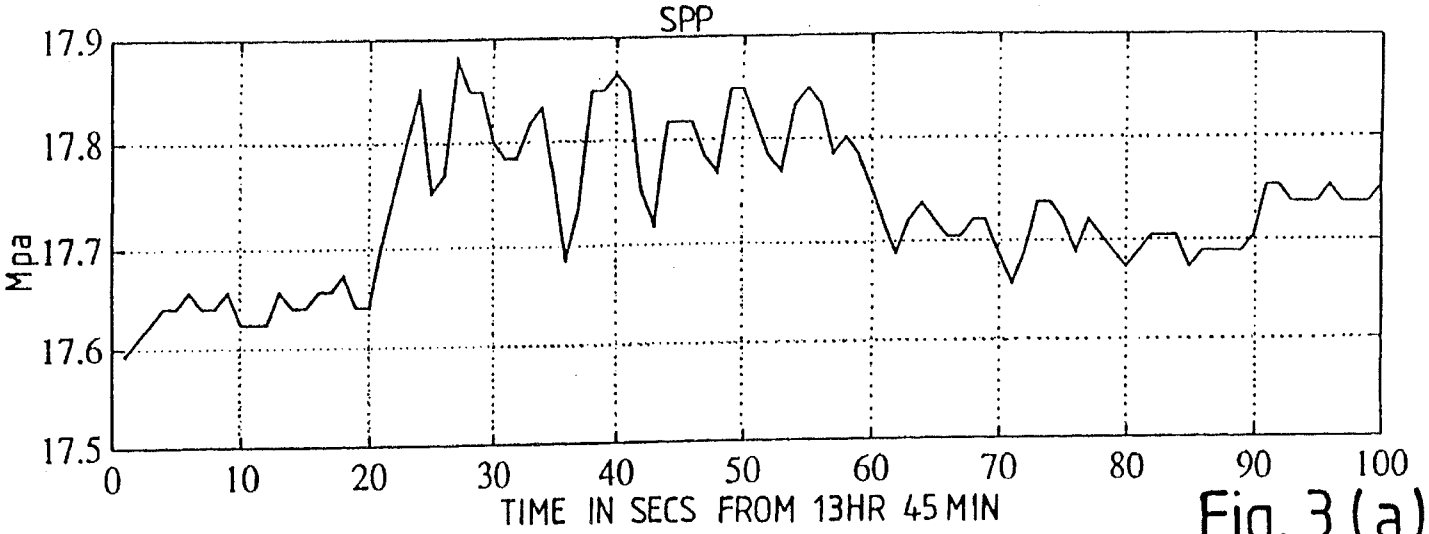
FIGS. 3*a* and 3*b* show expanded sections of the plots of FIGS. 2*a* and 2*b;*
Figure 3:
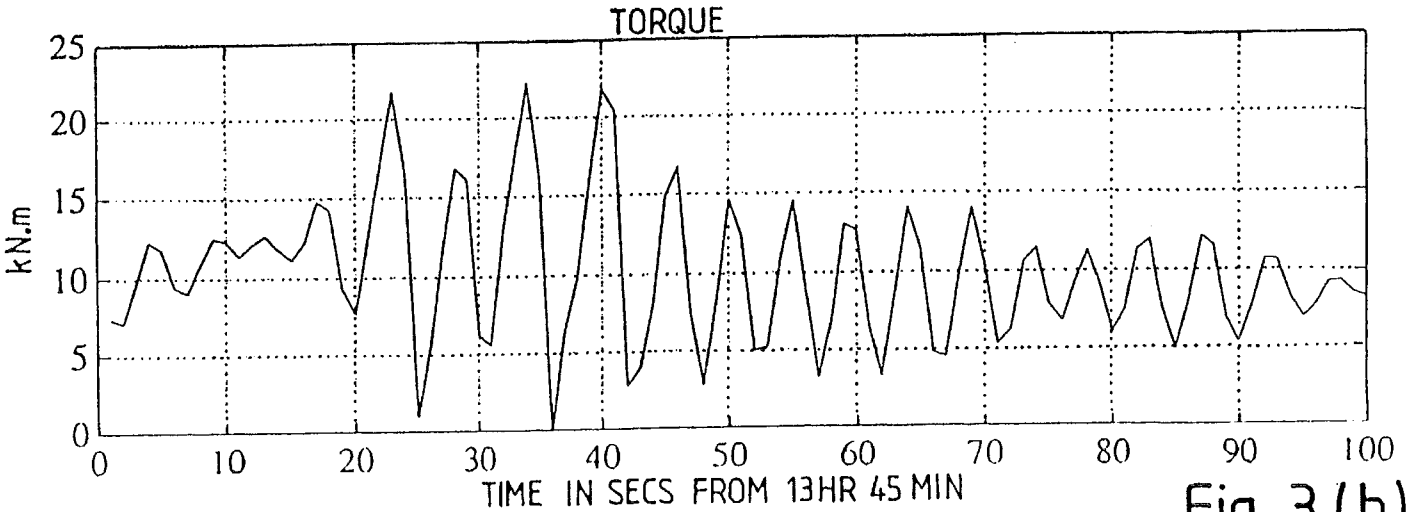
Figure 4:
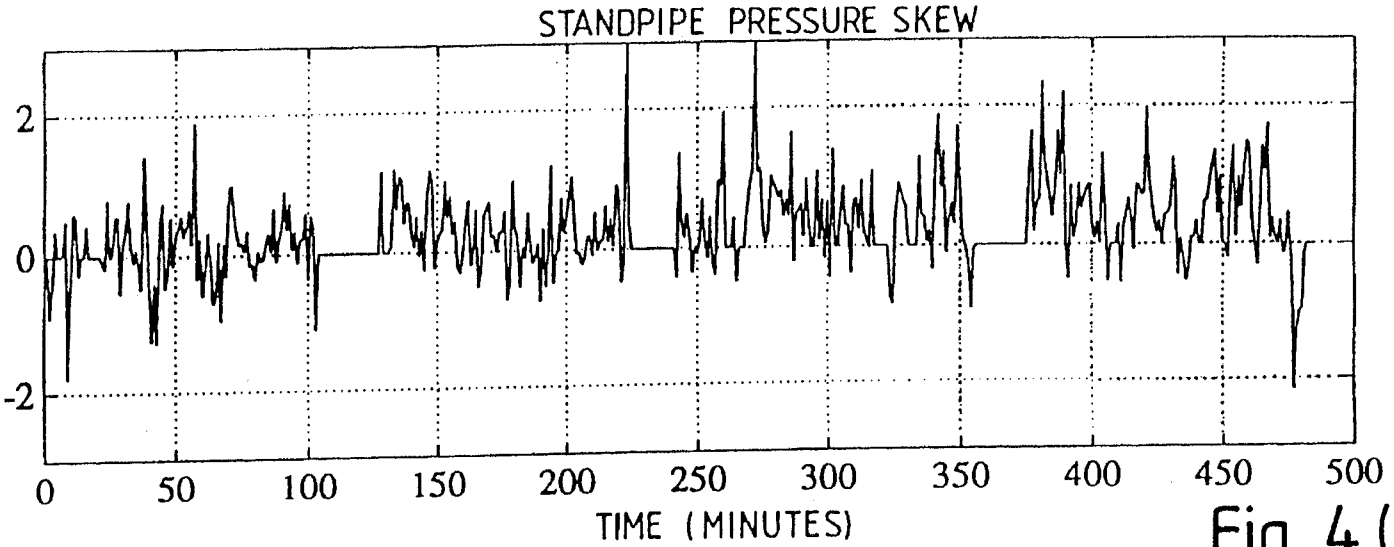
FIGS. 4*a* and 4*b* show skew and normalized standard deviation plots of data corresponding to FIGS. 2*a* and 2*b;*
Figure 4:
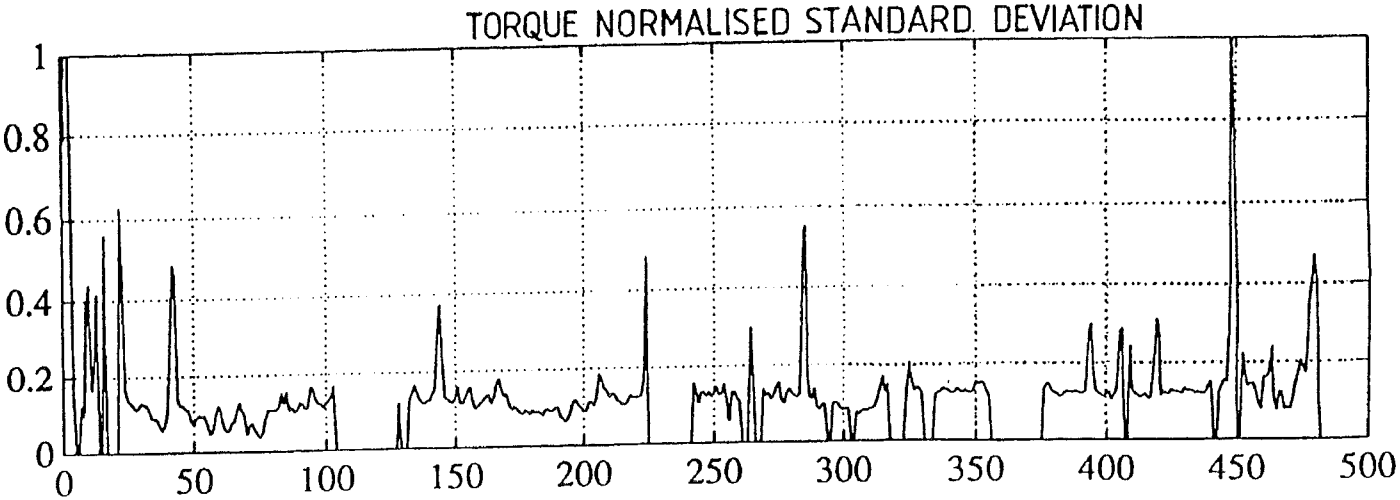

FIGS. 4*a* and 4*b* show the skew and normalized standard deviation data for standpipe pressure and torque respectively, for the eight hours preceding the stuck pipe event (including the period shown in FIGS. 2 and 3). This data has been obtained according to the method describe in relation to FIG. 1. Large positive pulses in the skew data are evident in the final few hours due to the pulses shown in FIG. 2*a*. Peaks also occur in the normalized standard deviation of the torque data corresponding to the large fluctuation in the raw data. The normalized standard deviation of the torque data provides a dimensionless quantity indicative of relatively large oscillation of the torque signal. When both plots are scaled similarly as in FIGS. 4*a* and 4*b*, peaks in the pressure skew data occur during section of relatively large torque fluctuation.

Figure 5:
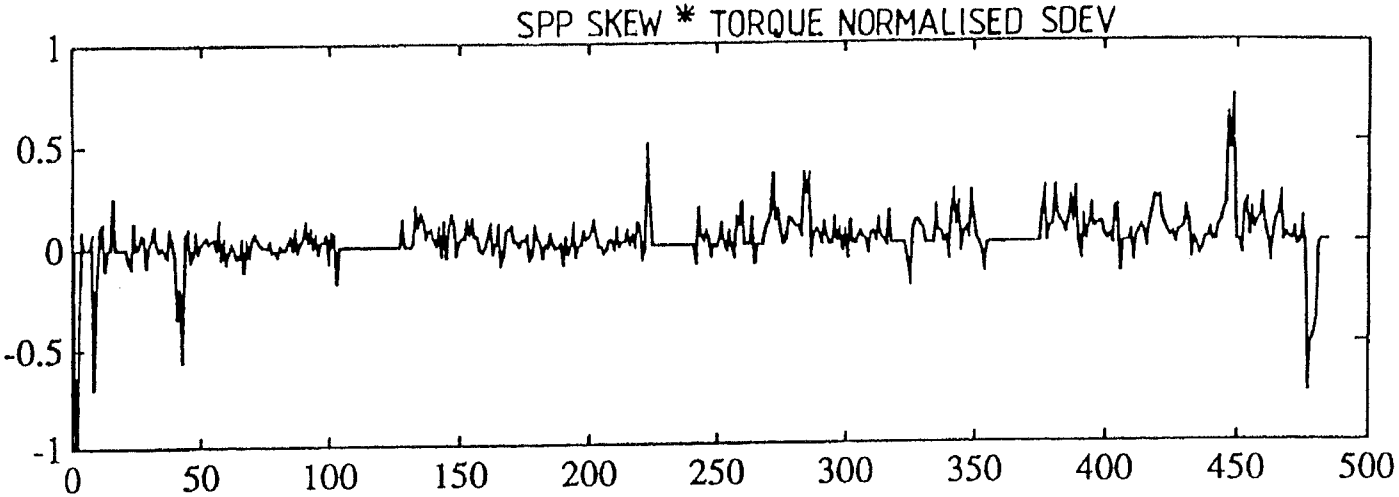
FIGS. 5*a* and 5*b* show plots of the development of the product of the skew and normalized standard deviation in its raw and integrated form.
Figure 5:
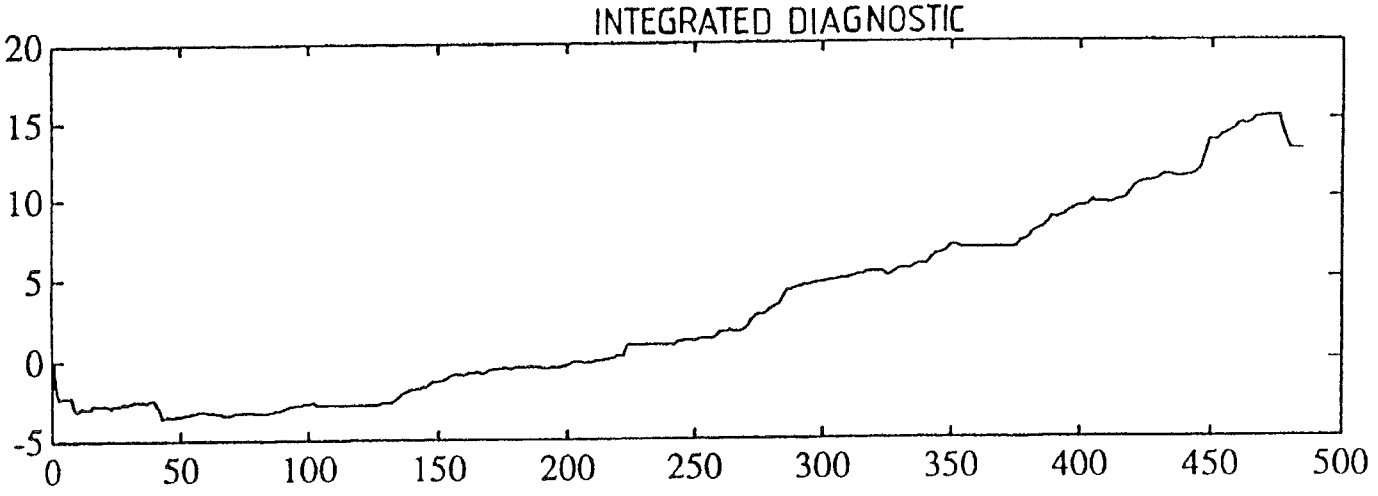

In order to provide a good warning of potential sticking problems, it is necessary to raise an alarm which is sensitive to both positive one-sided spikes occurring in the pressure skew data and to large amplitude oscillations of the torque. A suitable dimensionless diagnostic is the product of the normalized standard deviation of the torque and the skew of the standpipe pressure. A plot of this diagnostic is shown in FIG. 5*a*. Since it is desirable to raise an alarm in a real-time computing system, a more reliable diagnostic is the integrated value over a period of 1–2 hours as shown in FIG. 5*b*. The integral is updated at intervals of 1 minute and should normally be close to zero as the skew value oscillates between positive and negative values. However, it should be noted that pressure fluctuations cause for example by switching pumps on and off when connecting must not be included in the diagnostic. Increasing positive values of the integrated diagnostic can indicate worsening pipe sticking conditions and can be readily detected by triggering an alarm at some predetermined threshold. In the example shown, an alarm set at +5 would warn of possible problems 3 hours before drilling stopped to pull out of hole. This would allow time for other tests to be conducted to detect any likelihood of sticking and potential remedial action.

Figure 6A:
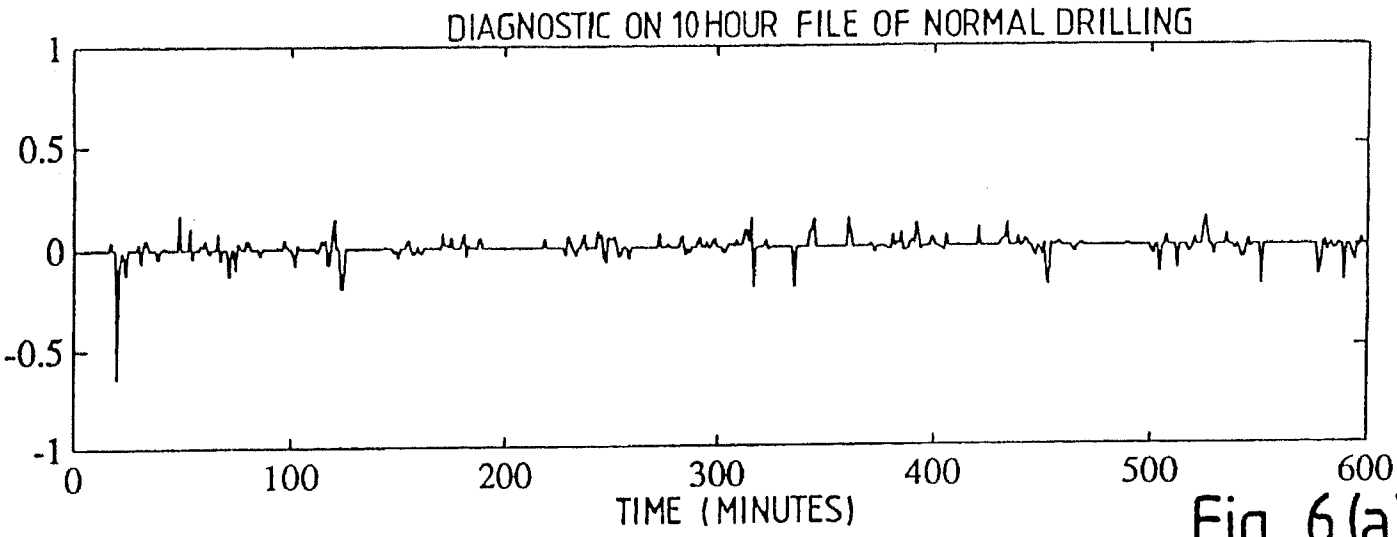
FIGS. 6*a* and 6*b* show the corresponding plots to FIGS. 5*a* and 5*b* for a period of normal drilling.
Figure 6B:
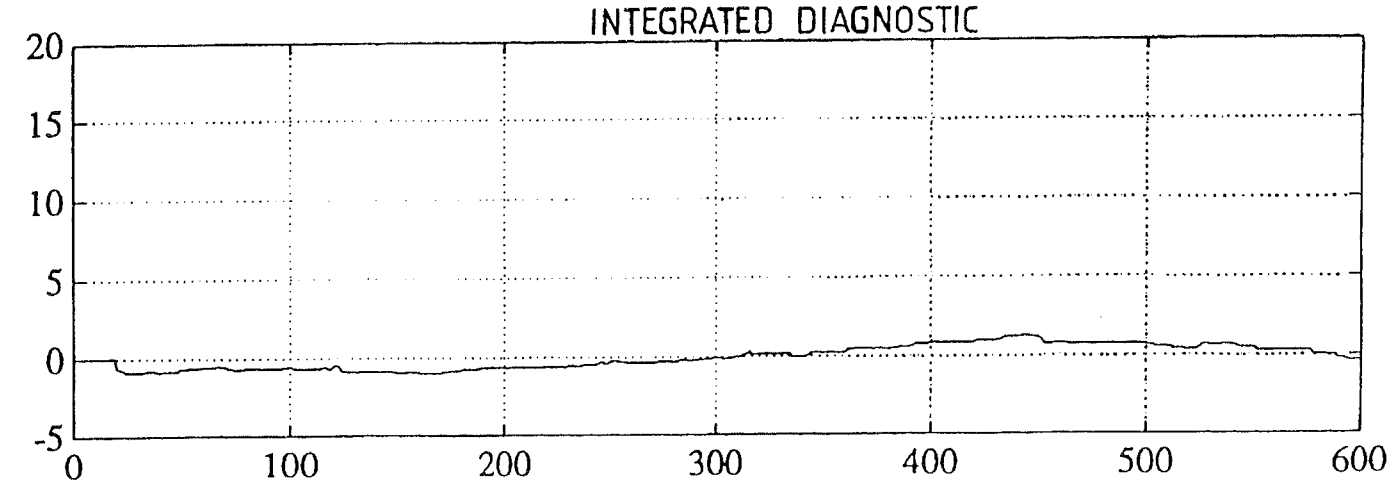

FIGS. 6*a* and 6*b* show corresponding plots to FIGS. 5*a* and 5*b*. While the diagnostic product shows peaks, the integrated diagnostic fluctuates only over +/−1 and so would not raise any false alarm.

What is claimed is:

1. A method of warning of the onset of pipe sticking in a rotary drilling operation using a drill string comprising:

(a) monitoring the pressure of a drilling fluid being pumped through the drill string during drilling-over predetermined periods of time to obtain a series of pressure measurements;

(b) monitoring the torque required to rotate the drill string during said periods to obtain a series of torque measurements;

(c) obtaining the skew (third moment) of each series of pressure measurements according to the relationship $$\text{skew} = \frac{1}{N}\ \Sigma[(xi - x\text{mean})/\sigma]^3,$$

wherein N is the number of pressure measurements xi in the series, xmean is the average value of the measurements in the series, and σ is the standard deviation of the measurements in the series;

(d) obtaining the normalized standard deviation σn of the torque measurements in each corresponding series of torque measurements according to the relationship $$\sigma n = (\sigma/y\text{mean})$$

wherein σ is the standard deviation of the measurements in the series and ymean is the average value of the measurements in the series; and (e) comparing skew and σn for the series so as to identify corresponding changes in both and raising an alarm when the magnitude of said changes pass predetermined alarm values.

2. A method as claimed in claim 1, wherein the step of comparing the skew and σn for the series comprises obtaining the product of the skew and σn and monitoring the development of said product and raising the alarm when the value of the product exceeds an alarm value.

3. A method as claimed in claim 2, wherein the product of skew and $\sigma n$ is integrated over a period of time and the integrated value is updated on a regular basis.

4. A method as claimed in claim 3, wherein the current value of the integral is used to trigger the alarm.

5. A method as claimed in claim 4, wherein the integration period is around 1–2 hours and the integrated value is updated at period of about one minute.

6. A method as claimed in claim 4, wherein the predetermined period of time is of the order of 120 seconds and calculations are repeated every 60 seconds.

7. A method as claimed in claim 5, wherein the predetermined period of time is of the order of 120 seconds and calculations are repeated every 60 seconds.

8. A method as claimed in claim 3, wherein the integration period is around 1–2 hours and the integrated value is updated at period of about one minute.

9. A method as claimed in claim 8, wherein the predetermined period of time is of the order of 120 seconds and calculations are repeated every 60 seconds.

10. A method as claimed in claim 3, wherein the predetermined period of time is of the order of 120 seconds and calculations are repeated every 60 seconds.

11. A method as claimed in claim 2, wherein the predetermined period of time is of the order of 120 seconds and calculations are repeated every 60 seconds.

12. A method as claimed in claim 1, wherein the predetermined period of time is of the order of 120 seconds and calculations are repeated every 60 seconds.

* * * * *